US005884354A

United States Patent [19]

Anderson

[11] Patent Number: 5,884,354

[45] Date of Patent: Mar. 23, 1999

[54] TOOTHBRUSH

[76] Inventor: Ray Charles Anderson, 7605 S. Quebec, Tulsa, Okla. 74136

[21] Appl. No.: 977,941

[22] Filed: Nov. 24, 1997

Related U.S. Application Data

[62] Division of Ser. No. 600,490, Feb. 13, 1996, abandoned.

[51] Int. Cl.[6] ..... A46B 9/04

[52] U.S. Cl. ..... 15/167.1; 15/172

[58] Field of Search ..... 15/167.1, 172

[56] References Cited

U.S. PATENT DOCUMENTS

| | | | |
|---|---|---|---|
| 424,716 | 4/1890 | Lichtenstein | 15/172 |
| 1,439,914 | 12/1922 | Saxe | 15/172 |
| 1,442,363 | 1/1923 | Saxe | 15/172 |
| 1,742,596 | 1/1930 | Hoff | 15/172 |
| 1,835,319 | 12/1931 | Myers | 15/172 |
| 2,047,613 | 7/1936 | Brown | 15/172 |
| 2,185,867 | 1/1940 | Pensky | 15/172 |
| 3,065,480 | 11/1962 | Sexton | 15/172 |
| 3,193,864 | 7/1965 | Makowsky | 15/172 |
| 3,350,737 | 11/1967 | Makowsky | 15/172 |
| 3,691,587 | 9/1972 | Makowsky | 15/172 |
| 3,868,742 | 3/1975 | Brenner | 15/172 |
| 4,106,152 | 8/1978 | Hadary | 15/172 |
| 4,403,623 | 9/1983 | Mark | 15/172 |
| 4,471,506 | 9/1984 | Massari | 15/172 |
| 5,499,422 | 3/1996 | Lavazoli | 15/177 |

FOREIGN PATENT DOCUMENTS

| | | | |
|---|---|---|---|
| 649074 | 8/1928 | France | 15/172 |
| 2325486 | 12/1974 | Germany | 15/172 |
| 2427877 | 12/1975 | Germany | 15/172 |
| 451877 | 5/1968 | Switzerland | 15/172 |
| 22340 | 10/1906 | United Kingdom | 15/172 |
| 331126 | 6/1930 | United Kingdom | 15/172 |

*Primary Examiner*—Randall E. Chin

[57] ABSTRACT

An improved toothbrush enables the user to brush more effectively the front and back of the upper and lower front teeth and vertically on the back teeth with the toothbrush handle perpendicular to the toothbrush allowing a more natural stroke of the hand and arm which will in turn provide for a more effective cleaning of the front teeth. For all other teeth, simply rotate the brush or handle to be in parallel with each other to offer the present day design for brushing teeth. For the parallel, fixed device, offering a round, square or hexagon head design, the ease of operation is created by bristles not only running thinly parallel with the handle as with present day brushes. This device offers wide bristles and accessibility to difficult areas to brush vertically or horizontaly without rotating the head handle. The extra widened bristle design with rows of bristles running vertically and horizontal. Present day toothbrushes have a narrow bristle construction that is limited by the width of the handle. For the switch operated rotating, indexing, swiveling toothbrush head, this device offers instantaneous changing of toothbrush head position with a thumb or finger operated switch. For the twist handle method, this device offers the indexing of the toothbrush head with a turn of the toothbrush handle.

2 Claims, 3 Drawing Sheets

TOOTHBRUSH

This application is a divisional of application Ser. No. 08/600,490 filed on Feb. 13, 1996 now abandoned.

BACKGROUND OF THE INVENTION

This invention relates generally to toothbrushes and more particularly to toothbrush ease of operation in and success in brushing all areas of the teeth and mouth.

SUMMARY OF THE INVENTION

Toothbrushes now in use are normally designed with the handle in line or parallel with the bristles or brush. To effectively brush the teeth, front, rear, inside and outside, a user must contort their wrists and hands and raise the arm to unnatural levels in an attempt to brush all teeth. With this improved invention, a user can simply place the handle in a perpendicular position with the brush for a more effective cleaning stroke parallel with the teeth or place the handle in a parallel position with the brush for cleaning teeth in a normal position. Also the round, square or hexagon parallel device offers accessibility to all areas of the teeth, vertically or horizontally using a fixed head and handle. The narrowness of the present day toothbrush along with the narrowness of bristles, force the user to put the hand, wrist and arm in contorting positions in an attempt to correctly clean the teeth. On the vertical movement of the brush across the teeth, up and down, to clean between the teeth, this problem stands out. With the widened bristle design on the round, hexagon or square toothbrush head, the user can effectively clean between the teeth by dropping their arm and hand to a comfortable position and moving the brush up and down, cleaning between the teeth with excellent results and ease of operation. The narrow bristle design of all toothbrushes toady cannot offer this new and improved feature and fail to clean the teeth properly. With the thumb or finger switch method, the indexing of the toothbrush head is accomplished with one hand and quickly changed from the parallel position to the perpendicular position and back to the parallel position. With the twist handle method, this device offers the indexing of the toothbrush head from parallel to perpendicular with a turn of the toothbrush handle.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of it's scope, for the invention may admit to other equally effective embodiments.

DESCRIPTION OF THE PREFERRED EMBODIMENT

Figure 1:
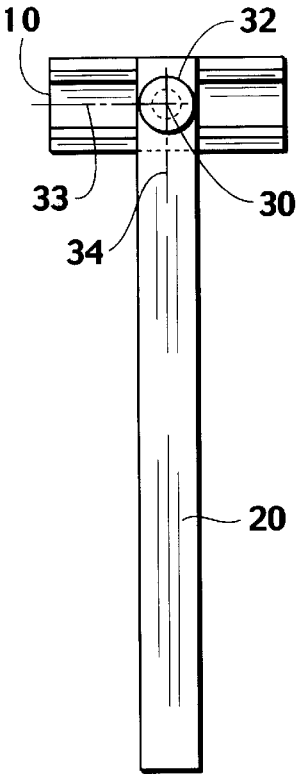
FIG. 1 Is a schematic top view of a toothbrush incorporating a preferred embodiment of this invention including a rotating brush head or rotating handle showing the toothbrush head perpendicular to the handle.

Referring now to the drawings and first to FIG. 1, a rotatable toothbrush is shown with the toothbrush head 10 having a longitudinal axis 33 perpendicular or transverse to the longitudinal axis 34 of the handle 20. This handle 20 and brush head 10 position allows for a more natural position of the hand and arm while stroking vertically on the front and rear teeth.

Figure 2:
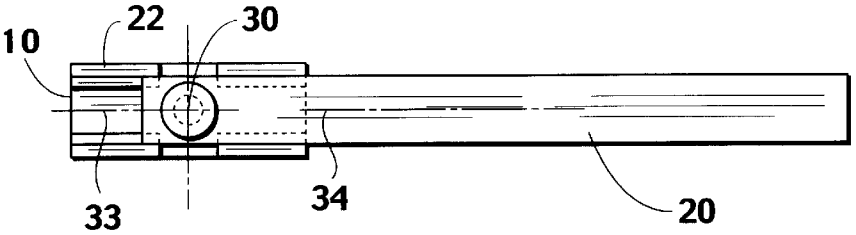
FIG. 2 Is a schematic top view of a toothbrush including a rotating brush head or rotating handle showing the toothbrush head parallel with the handle.

FIG. 2 is shown a rotatable toothbrush with toothbrush head 10 having its longitudinal axis 33 in parallel with the longitudinal axis 34 of the handle 20 and showing pivoting point 30 on an axis transverse to both the longitudinal axes 33 and 34 of the head 10 and the handle 20.

Figure 3:
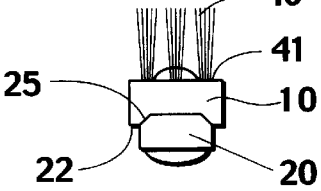
FIG. 3 Is an end view of the toothbrush including a rotating brush head or rotating handle showing the toothbrush head parallel with the handle.

FIG. 3 is showing an end view of the toothbrush with brush head 10, handle 20 and bristles 40, positioned in parallel. Angular locking position shown with ridge 22 and angle 25. As shown, the bristles 40 extend upwardly from one face 41 of the head 10 in a direction generally transverse to the longitudinal axes 33 and 34 of the head 10 and handle 20.

Figure 4:
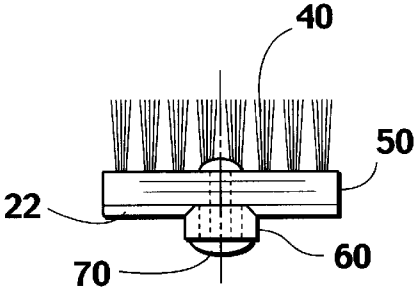
FIG. 4 Is an end view of the toothbrush showing the head perpendicular to the handle and showing an attachment method of the brush and handle.
Figure 5:
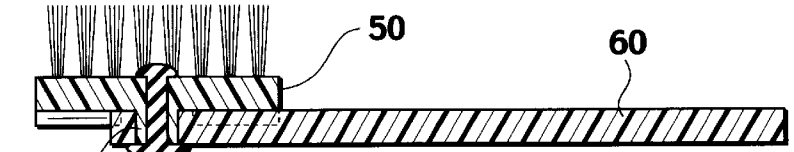
FIG. 5 Is a side view of the toothbrush showing the head parallel to the handle and showing an attachment method of the brush and handle.

FIGS. 4 and 5 is an end view and side view of the toothbrush showing assembly of brush head 50 with molded guide pin 52, handle 60 and flexible and stretchable type rubber pin 70.

Figure 6:
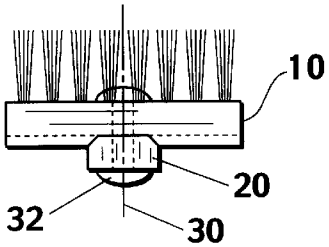
FIG. 6 Is an end view of the toothbrush showing the head perpendicular to the handle and showing an attachment method of the brush and handle.
Figure 7:
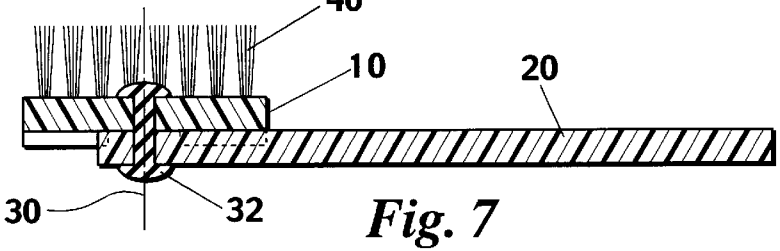
FIG. 7 Is a side view of the toothbrush showing the head parallel to the handle and showing an attachment method of the brush and handle.

FIGS. 6 and 7 is an end view and side view of the toothbrush showing assembly of brush head 10, handle 20 and flexible and stretchable type rubber pin 32.

Figure 8:
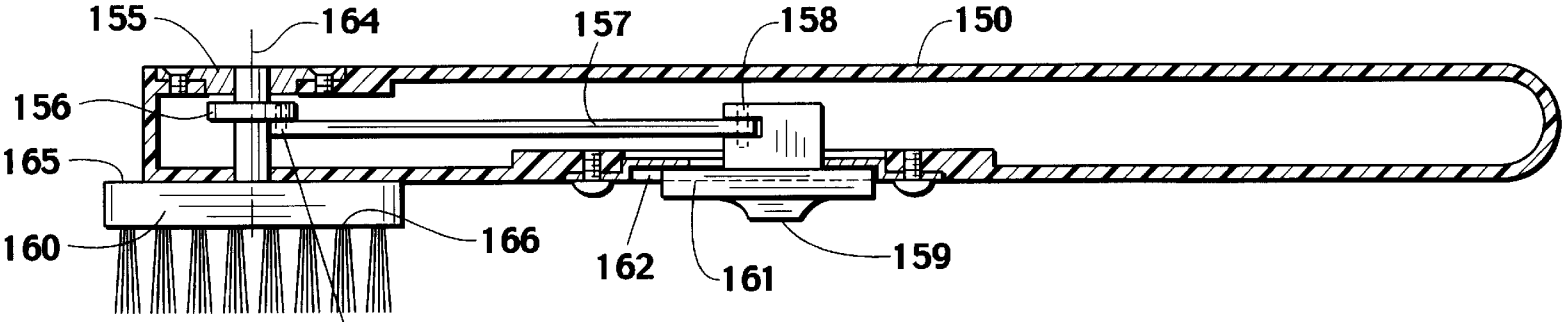
FIG. 8 Is a schematic side view incorporating a preferred embodiment of this invention including a rotating, indexing, swiveling, toothbrush head from parallel to perpendicular to the handle operated by a switch.

FIG. 8 is an indexing toothbrush with toothbrush head 160, indexing or rotating in relation to the handle 150 by switch 159. Switch 159 is attached to body 150 and the lever arm 157 is attached to switch 159 and drum 156 with pins 158. First pin 158 is mounted on a slide member 161 which is engaged in a longitudinally aligned track 162 in the handle 150. The lever arm 157 links the pin 158 connected to the slide 161 to the other pin 163 which is radially displaced from the pivot axis 164 and fixed to the drum 156 which extends from the face 165 of the brush head 160 opposite from the bristle face 166. Cover plate 155 is also incorporated.

Figure 9:
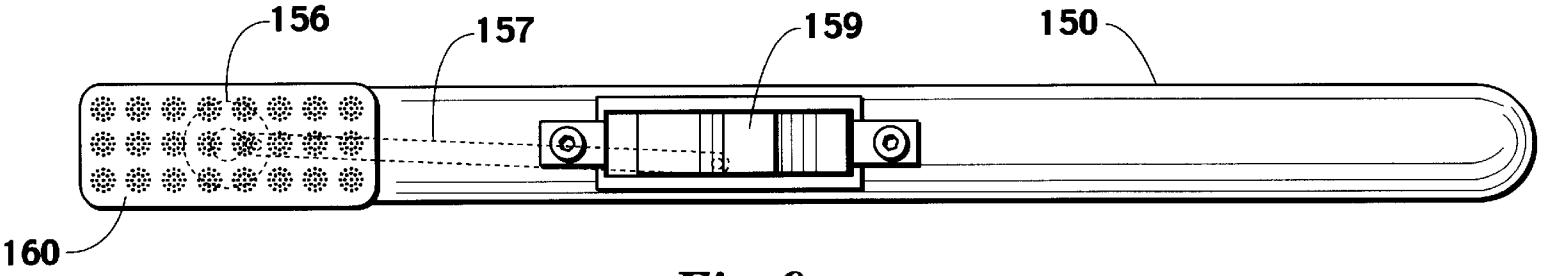
FIG. 9 Is a schematic top view showing the toothbrush head, parallel to the handle, with switch in rear position.

FIG. 9 shows toothbrush head 160 in a first position parallel with body 150 and switch 159 in rear position.

Figure 10:
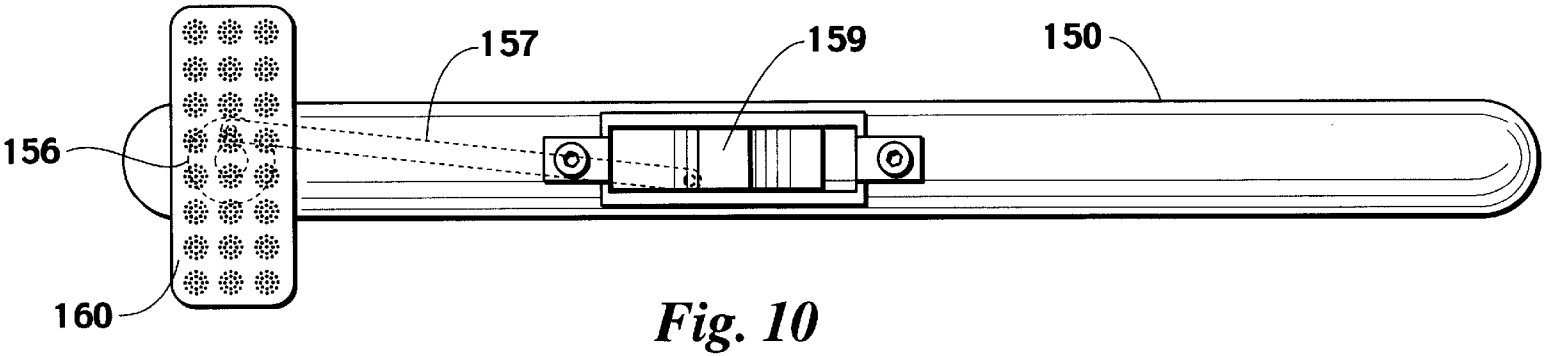
FIG. 10 Is a schematic top view showing the toothbrush head, perpendicular to the handle, with switch in forward position.

FIG. 10 shows toothbrush 160 in a second position perpendicular to the body 150 with switch 159 in the forward position.

Figure 11:
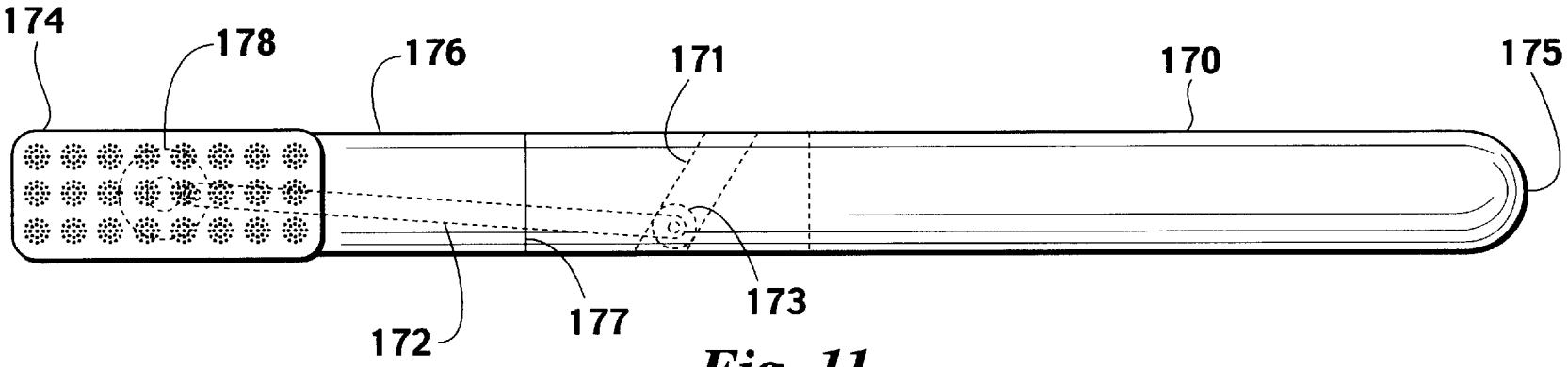
FIG. 11 Is a schematic top view incorporating a preferred embodiment of this invention including a rotating handle as a means to index the toothbrush head show in the parallel position.
Figure 12:
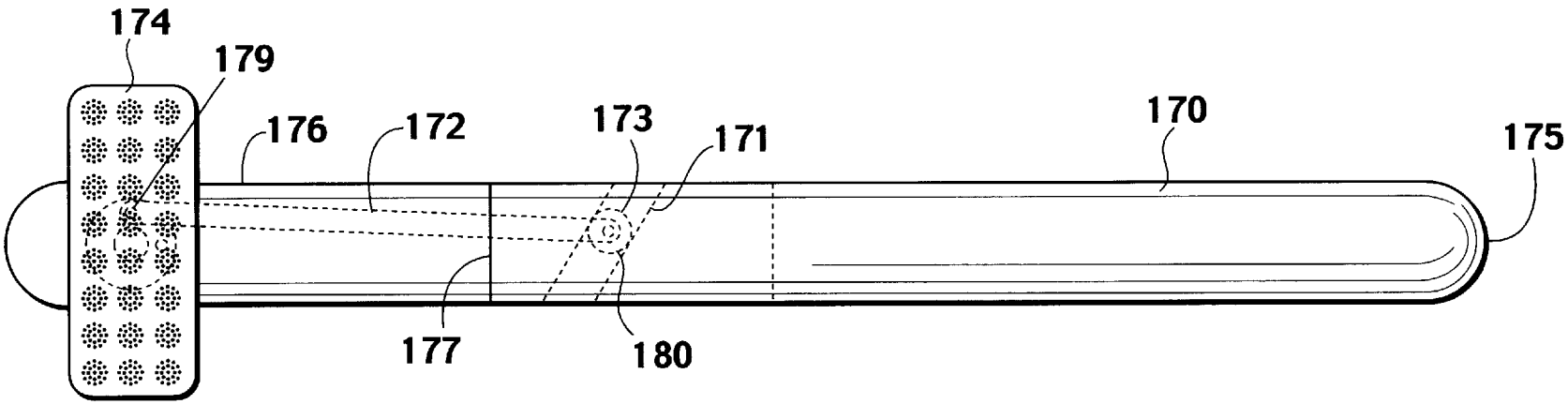
FIG. 12 Is a schematic top view showing the handle rotated and the toothbrush in the perpendicular position.

FIG. 11 is an indexing toothbrush with a handle 170 and a toothbrush head 174 indexing by helical groove slot 171, shown in parallel head position, with pin 173 shown fixed to carriage 180 in slot 171 attached by rod 172 to another pin 179 fixed to drum 178. When indexing, twist or rotate lower portion of handle 175 while holding upper portion of handle 176, allowing handle 175 at the split 177 to rotate. This advances the helix slot 171 and pushes rod 172 which indexes brush 174 from parallel to perpendicular as shown in FIG. 12.

What is claimed is:

1. A toothbrush comprising:

a handle having first and second ends and a longitudinal axis extending therebetween;

a head having a longitudinal axis and having bristles extending from one face thereof, said bristles being generally transverse to said head longitudinal axis;

means pivotally connecting said first end of said handle to said head at a longitudinal center of said head for relative rotation therebetween about an axis transverse to said handle and head longitudinal axes; and means on said handle operatively connected to said head for selectively rotating said head between a first position in which said handle and head longitudinal axes are substantially parallel and a second position in which said handle and head longitudinal axes are substantially transverse.

2. A toothbrush according to claim 1 further comprising means for selectively locking said head in a first position in which said handle and head axes are substantially parallel and in a second position in which said handle and head axes are substantially transverse.

* * * * *